US006340036B1

(12) United States Patent
Toyoizumi et al.

(10) Patent No.: US 6,340,036 B1
(45) Date of Patent: Jan. 22, 2002

(54) POWDERY-PARTICLES SUPPLYING METHOD AND APPARATUS, AND CONTROL METHOD FOR FLOWING SOLID-STATE SUBSTANCES

(75) Inventors: Yoshihiko Toyoizumi; Chuji Iino, both of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/592,711

(22) Filed: Jun. 13, 2000

(30) Foreign Application Priority Data

Jun. 16, 1999 (JP) ..... 11-169727

(51) Int. Cl.[7] ..... B65B 1/04
(52) U.S. Cl. ..... 141/275; 141/67; 141/44
(58) Field of Search ..... 141/275, 256, 141/286, 39, 47, 44, 93, 67, 65, 68, 69

(56) References Cited

U.S. PATENT DOCUMENTS 3,788,368 A * 1/1974 Geng et al. ..... 141/67
6,102,088 A * 7/2000 Wegman ..... 141/286

* cited by examiner

*Primary Examiner*—Steven O. Douglas
(74) *Attorney, Agent, or Firm*—Jordan B. Bierman; Bierman, Muserlian and Lucas

(57) ABSTRACT

A control method for discharging particles and an apparatus executing the method are disclosed. The control method includes steps of passing particles through a particles-supplying path connected to a supplying section of the particles at one end of it, and having a delivery opening for discharging the particles at the other end of it and controlling to form a cover consisting of at least a part of the particles by changing a density of at least a part of the particles existing in the particles-supplying path so as not to discharge the particles from the delivery opening. The apparatus includes a particles-supplying path connected to a supplying section of particles at one end of it, and having a delivery opening for discharging the particles at the other end of it and a passage controller for forming a cover consisting of at least a part of the particles by changing a density of at least a part of the particles existing in the particles-supplying path so as not to discharge the particles from the delivery opening.

25 Claims, 7 Drawing Sheets

POWDERY-PARTICLES SUPPLYING METHOD AND APPARATUS, AND CONTROL METHOD FOR FLOWING SOLID-STATE SUBSTANCES

BACKGROUND OF THE INVENTION

The present invention relates to a particles-supplying method and apparatus as well as a control method for flowing solid-state substances to supply particles into a container, and, more specifically, relates to a particles-supplying apparatus, in which particles such as toner particles for developing electro-photographic images, developing agents for photo-sensitive materials, cosmetic powder, pharmaceutical powder, powdery food, powdery mineral, etc., are conveyed from a supplying source and filling a container set in the apparatus. In addition, the shape and diameter of each powdery particle are required to be uniform in the abovementioned particles.

In the conventional particles-supplying apparatus for supplying particles, such as toner particles for developing electro-photographic images, etc., into a container, particles are invariably scattered by freely falling from the outlet opening, since the mass density of particles existing around the outlet opening decreases due to an air inflow from outside.

The scattered particles would contaminate the periphery of the apparatus and the container, resulting in the deterioration of the working environment where the filling work of particles is performed. Specifically, when particles, which possibly affect human health and environment, such as chemical powder, etc., are handled, harmful influences of scattered particles would become a big problem. Further, when flammable particles are handled, there is a dangerous possibility that floating particles scattered in the air could cause an explosion of the particles.

To prevent particles from dropping and scattering at the outlet opening due to air inflow from outside and/or vibration, it is well known to provide a capping cover at the outlet opening in the apparatus, in order to cover the outlet opening. In addition, it is also well known to provide a movable sliding cover at the outlet opening in the apparatus, so as to supply particles into the container by opening the movable sliding cover when the apparatus detects a setting status of the container in the apparatus, and to close the outlet opening by moving the movable sliding cover to the initial position after a predetermined amount of particles is filled in the container.

It is inevitable, however, that some particles would remain, adhering onto the capping cover or onto the movable sliding cover. Whenever the sliding cover moves, the adhered particles form into small lumps of particles. It has been a problem when such lumps of particles are mingled with the particles in the container, resulting in deterioration of the product quality.

Specifically for the toner particles for developing electro-photographic images, since high-precision uniformity is required in the dimension of each particle, such the mingled lumps of particles directly have a major adverse influence on the finished quality of electro-photographic images.

Therefore, it has been an urgent subject to develop a particles-supplying apparatus having a function, instead of using the capping cover or the movable sliding cover, for preventing particles dropping from the outlet opening and scattering around the outlet opening due to air inflow from the delivery opening, a decrease of mass density and/or vibration, etc.

Technologies rendering elimination of air existing between particles are already set forth in Tokkaisho 57-1001, JP-2748934 and Jikkousho 46-15837.

The objects of the abovementioned technologies, however, are to prevent the fine particles from scattering when filling the particles into a bag, to prevent residual air inflow into the container, generated simultaneously when filling it with particles, and to increase the mass density of particles in the container by deaerating the particles, namely, to reduce or eliminate the amount of air inflow with particles when filling particles into the container. In addition, the abovementioned technologies merely disclose a technique to eliminate a plugging state occurred at the aerating section by supplying the air into the supplying path. Therefore, the abovementioned technologies have disclosed neither such a method nor an apparatus, which prevents particles dropping from the outlet opening by stopping the air inflow from the outlet opening.

SUMMARY OF THE INVENTION

Accordingly, to overcome the abovementioned problems, the first object of the present invention is to provide a particles-supplying apparatus having a function, instead of using the capping cover or the movable sliding cover, for preventing particles dropping from the outlet opening and scattering around the outlet opening due to air inflow from the delivery opening, decrease of mass density and/or vibrations, etc.

Further, the second object of the present invention is to provide a control method for supplying particles, in order to produce high quality products of particles, mingled with no lumps of particles, by excluding the capping cover or the movable sliding cover from the delivery opening.

Moreover, another object of the present invention is to provide a particles-supplying apparatus, in which a specified amount of particles can be supplied into the container.

Furthermore, another object of the present invention is to provide particles-supplying apparatus, in which the automatic measurement process of particles amount can be simplified.

To overcome the cited shortcomings, the abovementioned objects of the present invention can be attained by a particles-supplying apparatus described as follows.

(1) A particles-supplying apparatus, comprising: a particles-supplying path connected to a supplying section of particles at one end of it, and having a delivery opening for discharging the particles at the other end of it; and a passage controller for forming a cover consisting of at least a part of the particles by changing a density of at least a part of the particles existing in the particles-supplying path so as not to discharge the particles from the delivery opening.

Further, to overcome the cited shortcomings, the abovementioned objects of the present invention can be attained by control methods for supplying particles described as follow.

(2) A control method for discharging particles, comprising steps of: passing particles through a particles-supplying path connected to a supplying section of the particles at one end of it, and having a delivery opening for discharging the particles at the other end of it; and controlling to form a cover consisting of at least a part of the particles by changing a density of at least a part of the particles existing in the particles-supplying path so as not to discharge the particles from the delivery opening.

(3) A control method for flowing solid-state substances, comprising steps of: letting solid-state substances existing in a flowing fluid, so as to flow the solid-state substances with the flowing fluid in a flowing path; and allowing a flow of the solid-state substances to be restrained or to be free, by sucking the flowing fluid from the flowing path toward outside of the flowing path, or by gushing the flowing fluid into the flowing path from outside of the flowing path.

(4) A toner supplying apparatus, comprising: a supplying section of toner; a toner-supplying path connected to the supplying section of toner at one end of it, and having a delivery opening for discharging the toner at the other end of it; and a passage controller for forming a cover consisting of at least a part of the toner by changing a density of at least a part of the toner existing in the toner-supplying path so as not to discharge the toner from the delivery opening.

(5) A control method for discharging toner, comprising steps of: passing developer through a toner-supplying path connected to a supplying section of toner at one end of it, and having a delivery opening for discharging the toner at the other end of it; and controlling to form a cover consisting of at least a part of the toner by changing a density of at least a part of the toner existing in the toner-supplying path so as not to discharge the toner from the delivery opening.

BRIEF DESCRIPTION OF THE DRAWINGS

Other objectives and advantages of the present invention will become apparent upon reading the following detailed description and further upon reference to the drawings in which.

DETAILED DESCRIPTION OF THE PREFERRED EMBODIMENT

Figure 1:
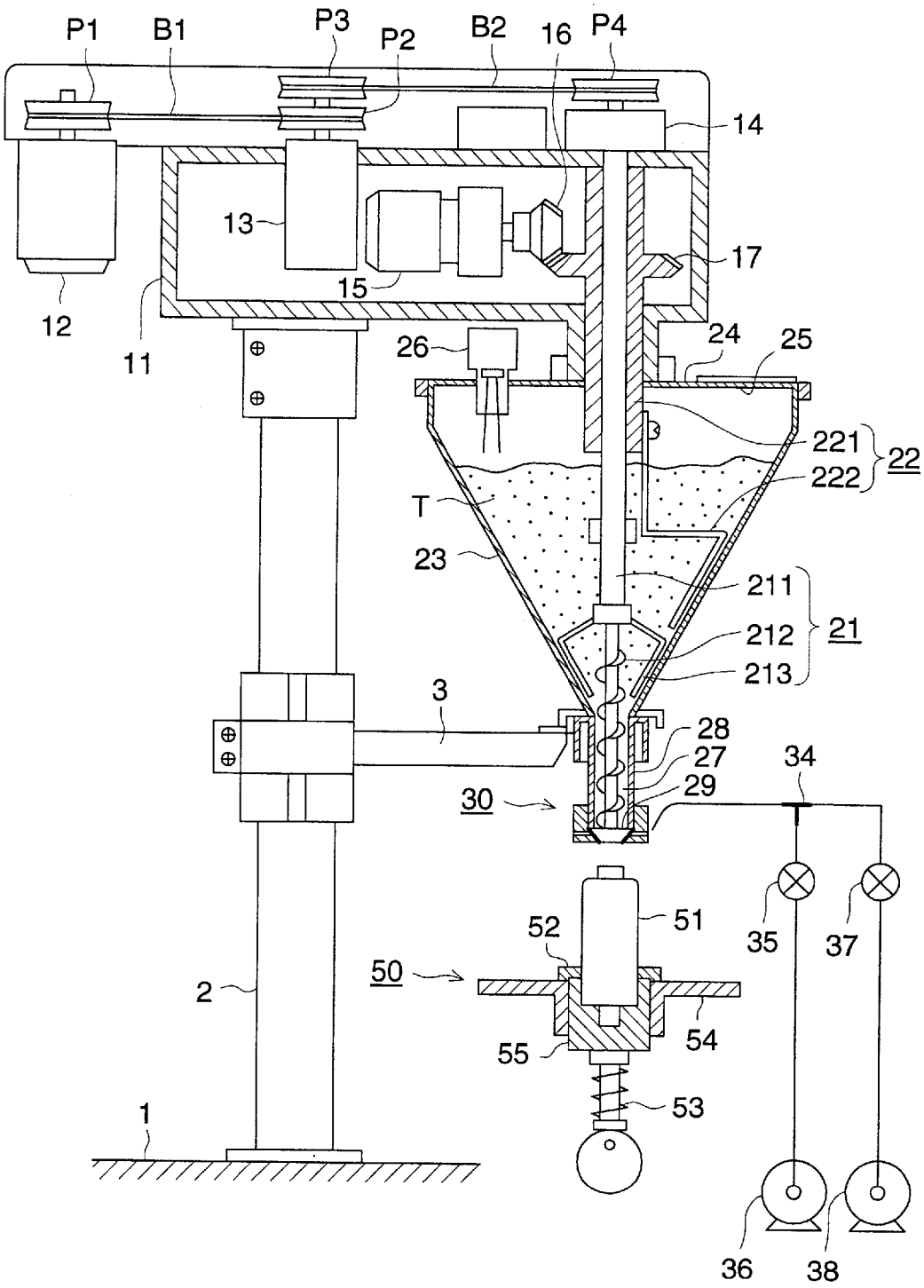
FIG. 1 shows the total configuration of the toner supplying apparatus, as an example of the particles-supplying apparatus embodied in the present invention.

Referring to the drawings, a particles-supplying apparatus, embodied in the present invention, will be described in the following.

Incidentally, the term of "particles" defined in the present invention denotes a collection of super-fine particles, and also denotes a state of solid-state fine particles including gas-gaps or liquid-gaps formed between particles. In addition, in the state when solid-state fine particles touch each other, each particle exerts cohesive force onto adjacent particles. Examples of the "particles" include an electrophotographic developer such as, toner, one-component developer, two-component developer, etc., and also include rice grains, barley grains, powdery wheat, instant-coffee, pharmaceutical powder, cosmetic powder, etc., in addition to mineral powder, suspensions, colloidal solution, slurries, etc.

Further, the "particles" defined in the present invention denote a state of solid-state fine particles which maintain a cohesive state under the relative-action of van der Waals force, etc., when the particles are in touch with each other. The dimension of each particle included in the "particles" ranges from the dimension barely perceptible by the human eye to the dimension on the order of microns, for instance, ranging from the dimension of rice grains having a diameter of several millimeters to the dimension of electrophotographic developer particle having a diameter of 3~20 $\mu$m, and further to the dimension of carbon black powder particles having a diameter of around 0.1 $\mu$m.

In addition, the gas deaerated and ventilated from/to the particles-supplying apparatus may be air, nitrogen gas or inert gas, etc., and the most suitable gas should be selected corresponding to the characteristic of the particles employed.

Further, the term of "density of particles", defined in the present invention, is the mass of the particles per unit volume, including the volume of gas or liquid existing in gaps between particles, namely, it denotes mass density. The mass density varies depending on the packing state of the particles, and, in the present invention, the mass density is varied by changing the packing state from a maximum packing state to a state of releasing the cohesive force among particles. In addition, a mixture of different sorts of particles, such as, for instance, two components developer containing a carrier and a toner, instant coffee containing sugar, Japanese seasoning containing seven different spices (a ground mixture of red pepper and aromatic spices), etc., is applicably included in "the particles" defined in the present invention.

Further, the term of "particles-supplying path", defined in the present invention, is a pathway through which the particles pass so as to supply the particles stored in the particles-supplying section to the container set in the apparatus, for instance, a pathway formed in a hollow cylindrical shape. One end of the "particles-supplying path" is connected to the particles-supplying section, such as a hopper, etc., and an outlet opening is formed at the other end of it, so that the particles are supplied to a container placed opposite the outlet opening, passing through the "particles-supplying path". Further, the "particles-supplying path" is provided with a mechanism located at a specific position in the path to change and adjust the density of the particles passing through the path. In addition to the above mechanism, it is also applicable to provide a kind of screw member for facilitating the passing action of the particles in the path.

Incidentally, "to change and adjust the density of at least a part of the particles existing in the particles-supplying path", described in the present invention, is to adjust the mass density of the particles existing at a specific position in the path, and to change and adjust the volume of gas or liquid residing in the gaps between adjacent particles.

Namely, the high-density state of particles, described in the present invention, is a condensed state of particles, in which the number of particles per unit volume is increased as a result of reducing the gaps among adjacent particles in the particles-supplying path, for instance, by performing deaerating, dehydrating or depressurizing action.

While the low-density state of particles, described in the present invention, is a dispersed state of particles, in which the number of particles per unit volume is decreased as a result of enlarged gaps between the particles in the particles-supplying path, for instance, by increasing the air pressure with the inflowing air into the particles-supplying path.

Further, "the passage controller", described in the present invention, performs control actions to enable or disable supply of particles into the container from the particles-supplying path through the outlet opening of the apparatus. The abovementioned control actions, for enabling or disabling the supply, are achieved by changing the density of at least a part of the particles existing in the particles-supplying path.

The series of actions performed by the passage controller, associated with the density change of the particles, are controlled by a program including steps of, for instance, detecting the container setting on the apparatus by means of the sensor equipped in the apparatus, changing the density of the particles when a predetermined time passes after the sensor is activated by a timer and enabling or disabling supply of the particles into the container.

In the particles-supplying apparatus, embodied in the present invention, it is also applicable that a diameter of the delivery opening is different from that of the particles-supplying path. Specifically, it is desirable that the diameter of the delivery opening is smaller than that of the particles-supplying path, for instance, it is more desirable that the particles-supplying path is tapered in the vicinity of the delivery opening.

Further, "the particles-supplying section", described in the present invention, should have functions of collecting the particles at a fixed storing position and supplying the particles into the particles-supplying path. Therefore, as an example, a device like a hopper would be suitable for the particles-supplying section.

Further, as for the "ventilator", employed for deaerating and aerating air in the desirable embodiment of the present invention, it is acceptable that either the same ventilator or the separate ventilators is/are employed for deaerating and aerating operations.

Still further, in the present invention, the "cover", formed by the particles, includes such a cover that delivers a part of the particles to outside, due to a deformation of it with time.

Figure 2:
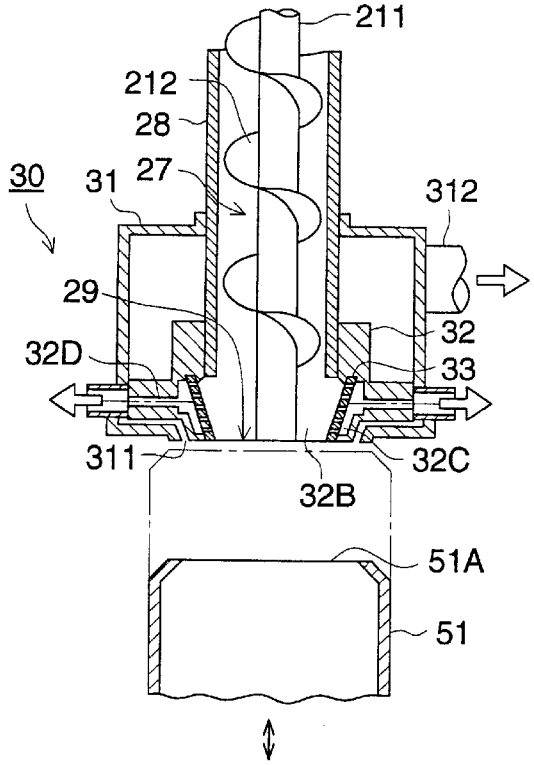
FIGS. 2(*a*) and 2(*b*) show partial cross-sectional views of the toner supplying apparatus, as examples of the particles-supplying apparatus embodied in the present invention.
Figure 2:
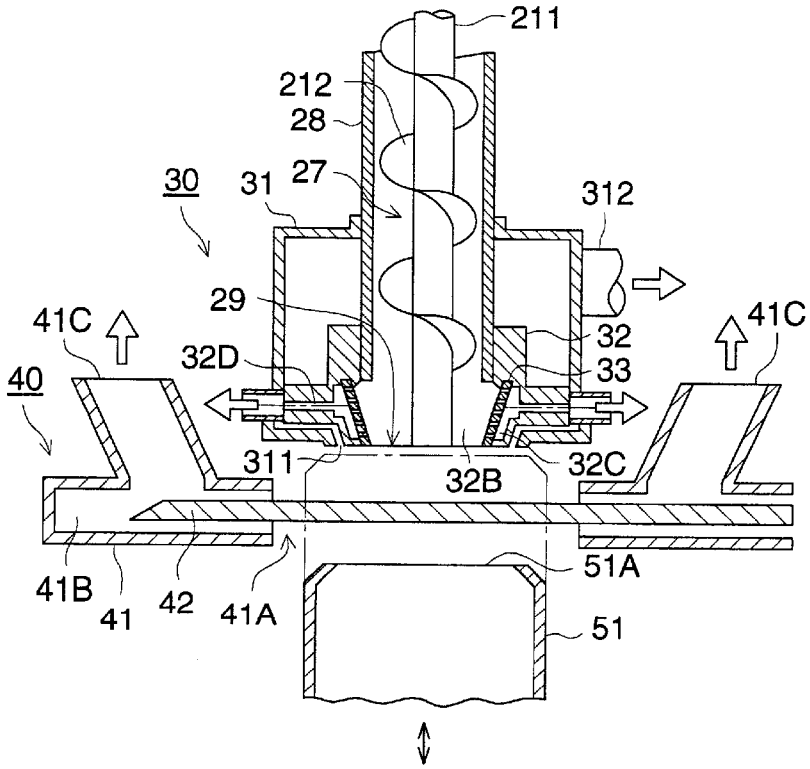

FIG. 1 shows the total configuration of the toner supplying apparatus, as an example of the particles-supplying apparatus embodied in the present invention. FIG. 2 shows a partial cross-sectional view of the toner supplying apparatus, as an example of the particles-supplying apparatus embodied in the present invention.

As shown in FIG. 1, housing 11 containing a driving means is mounted on the top end of column stand 2 fixed on base 1 of the toner supplying apparatus. The driving means comprises driving motor 12, electromagnetic brake 13, electromagnetic clutch 14, driving motor 15, and the driving force transmitting means including pulleys P1, P2, P3, P4, and belts B1, B2, etc.

When activating a power source, driving motor 12 starts continuous rotation and drives electro-magnetic brake 13 through pulleys P1, P2 and belt B1. Electro-magnetic brake 13 instantaneously stops the driving means by abruptly decreasing the rotating inertia when driving motor 12 is stopped.

Pulley P3, mounted on the same axis of pulley P2, transmits driving force to pulley P4 through belt B2. Electro-magnetic clutch 14, mounted on the same axis as pulley P4, drives auger 21 at appropriate times.

Bevel gear 16 attached to the driving axis of driving motor 15 gears with bevel gear 17 integrally formed on rotating axis 221 to rotate agitator 22. Rotating axis 211 is rotatably supported in a hollow cylinder aligned along the central axis of rotating axis 221.

Screw 212 and agitating member 213 are attached to the lower end portion of rotating axis 211 included in auger 21, integrally rotating with rotating axis 211.

Agitating member 222 is attached to the lower end portion of rotating axis 221 included in agitator 22, integrally rotating with rotating axis 221. Agitating member 222 and agitating member 213 agitate toner particles T by rotating in opposite directions each other, to prevent cohesion of toner particles and to keep the gap distances between toner particles uniform.

The lower sections of auger 21 and agitator 22 are enclosed in hopper 23. The lower section of hopper 23, shaped like a circular cone, is formed as a small opening of a supplying path, and is connected to particles-supplying path 27.

The upper section of hopper 23 is formed as a large opening and is air-tightly closed by upper cover 24. Toner replenishing opening 25 and sensor 26 are equipped on upper cover 24. Sensor 26 detects the upper level of toner particles T contained in hopper 23.

The tip of arm member 3 attached to column stand 2 supports supplying pipe 28 comprised in particles-supplying path 27. The inlet opening at the upper portion of particles-supplying path 27 is connected to hopper 23.

Toner particles T contained in hopper 23 are conveyed by screw 212 and are delivered through delivery opening 29.

A plurality of ventilation ducts 32D are connected to the pipeline which goes to through T-shaped branch 34 and electromagnetic valve 35. The other pipeline diverging from T-shaped branch 34 is connected to depressurizing pump 38 through electro-magnetic valve 37.

When compressor 36 is driven, compressor 36 sends a pressurized airflow to ventilation ducts 32D by closing electromagnetic valve 37 and by opening electromagnetic valve 35, in order to allow supplying path 30, which incorporates the ventilator embodied in the present invention, to be in a pressurized state (air supply state). When depressurizing pump 38 is driven, depressurizing pump 38 deaerates ventilation ducts 32D by closing electromagnetic valve 35 and by opening electromagnetic valve 37, allowing supplying path 30 to be a depressurized state (deaerated state).

Container setting means 50 is arranged right under delivery opening 29. Container setting means 50 comprises container-holding means 52 to hold container 51, container-elevating means 53 to raise and drop the opening of container 51 close to and apart from delivery opening 29 embodied in the present invention, container-placing table 54 to maintain container-holding means 52 being capable of rising and falling, sensor 55 to detect the existence of container 51 and the filling amount of toner in container 51, etc. Incidentally, a timer controlling method is also applicable for detecting the finish of filling in the container.

Container 51, which contains toner particles T delivered from delivery opening 29 of the particles-supplying apparatus embodied in the present invention, includes not only rigid containers made of materials such as a plastic, a glass, a ceramic, etc., which are not deformed easily by the external force, but also flexible containers made of materials such as a paper, a film, etc., which are easily deformed by the external force.

In the present invention, supplying pipe 28 is embedded into the double structures comprising casing member 31 and airtight cylinder 32 arranged near delivery opening 29 located within casing member 31.

The upper opening of the hollow section formed in airtight cylinder 32 is led through delivery opening 29 located at the lower side of supplying pipe 28, while the lower opening is located opposite inlet opening 51A of container 51.

VENTILATOR 33, being a hollow cylindrical shape, is inserted into the inner wall of the hollow section formed in airtight cylinder 32 and is fixed to the inner wall. Ventilator 33 divides the hollow section into inner hollow room 32B and outer hollow room 32C.

Inner hollow room 32B is connected to delivery opening 29, while outer hollow room 32C is connected to the pipeline through ventilation ducts 32D. Incidentally, the sidewall of ventilator 33 is formed as a conical shape in which an aperture of the lower end opening is squeezed smaller than that of the upper opening. For instance, the dimension of ventilator 33 is a conical shape, in which the inner diameter of the upper end opening is 50 mm, the inner diameter of the lower end opening is 38 mm and a height is 5 mm.

As mentioned above, since the diameter of the delivery opening is smaller than the diameter at any portion of the supplying path, the cover of the particles can be easily formed in the vicinity of the delivery opening.

Air intake 311, formed between the bottom of casing member 31 and the periphery of the bottom of ventilator 33, is connected to the inner room of casing member 31. When the depressurizing pump (not shown in the drawings) is driven, the inner room of casing member 31 is depressurized by sucking the air through ventilation duct 312, and then, toner particles floating around the lower side of airtight cylinder 32 are absorbed through air intake 311.

In the particles-supplying apparatus, embodied in the present invention, particles are supplied to container 51, in a manner such that the density of at least a part of the particles, existing in the particles-supplying path, is changed and adjusted by deaerating gas existing in gaps between particles or by aerating gas to the deaerated portion of the particles. The deaerating and aerating actions are achieved through ventilator 33 as shown in FIG. 2(*b*), and, thereby, when the deaerating action, particles are interrupted only to deaerate gas from the particles.

Figure 3:
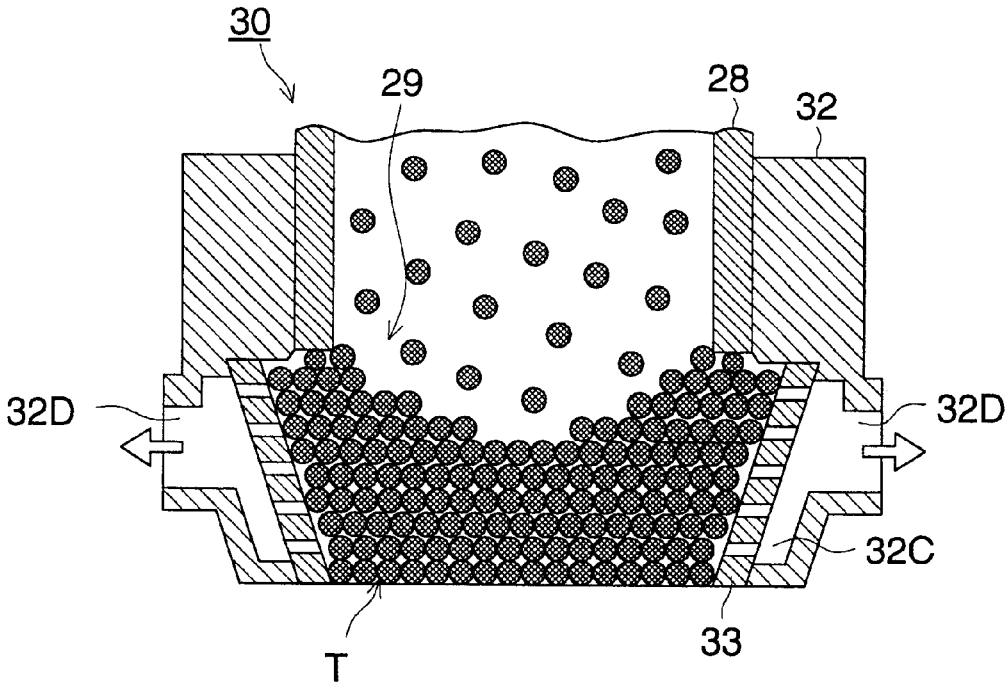
FIG. 3 shows an enlarged partial cross-sectional view of the toner supplying apparatus, illustrating the state of deaerating the toner particles existing at the delivery opening.

FIG. 3 shows an enlarged partial cross-sectional view of the toner supplying apparatus, illustrating a state of deaerating the toner particles existing at the delivery opening.

When a deaerating action, by means of depressurizing pump 38, reduces the air pressure in outer hollow room 32C up to a negative pressure, only the air existing between toner particles passes through ventilator 33 to increase the density of toner particles and to shorten the distances between toner particles. As a result, a collection of toner particles, in a state of a high mass density, blocks delivery opening 29 to prevent the air inflow from opening section 33A. Therefore, the natural falling of toner particles T from delivery opening 29 is successfully prevented.

While the abovementioned deaerating action is performed, the replenishment of toner particles and the rotational driving action for auger 21 are disabled.

Although various kinds of materials having a ventilating property are applicable for the materials of ventilator 33, it is a desirable embodiment in the present invention to employ a sintered metal, a stainless mesh plate, a non-textured fiber filter, etc. through which particles can not penetrate, but only the air existing between the particles can pass.

In the following, desirable examples of ventilator 33, embodied in the present invention, will be briefly described, in regard to (*a*) a sintered metal, (*b*) a stainless metal and (*c*) a non-textured fiber filter.

(*a*) The following is the consideration result of the nominal filtering accuracy for a sintered metal, namely, the pore diameter of the sintered metal (being the diameter of each mesh hole in the sintered metal).

As for toner particles T having an average volume diameter of 10 $\mu$m for each particle and accumulated at delivery opening 29, ventilator 33 made of the sintered metal having the nominal filtering accuracy of 10–150 $\mu$m is desirable, while 70–150 $\mu$m is more desirable, and 100–140 $\mu$m is the most suitable.

Namely, when the nominal filtering accuracy is less than 10 $\mu$m, the efficiency of deaeration decreases considerably, since mesh holes are blocked by the toner particles and air ventilation through the mesh holes is impeded, due to the excessively fine openings of the sintered metal. Accordingly, it becomes impossible to form a collection of the toner particles having a high mass density in ventilator 33 located at the lower side of delivery opening 29. Even if a collection of the toner particles is formed, it would fall down from delivery opening 29 of ventilator 33, due to insufficient mass density of the collection.

On the other hand, when the nominal filtering accuracy is greater than 150 $\mu$m, the toner particles would pass through the mesh holes along with the deaerating air, due to the excessively coarse mesh of the sintered metal. As a result, it becomes difficult to form a cover of toner particles, since toner particles hardly cohere each other in inner hollow room 32B. Even if a collection of the toner particles is formed, it would drop from delivery opening 29, due to insufficient mass density of the collection.

Although the abovementioned ventilator 33 is formed of a sintered metal, it is also applicable to employ materials formed by sintering synthetic organic resin particles such as ABS resin, polyethylene, polypropylene, etc. or inorganic particles such as glass, etc.

(*b*) When a plane-weaved stainless wire mesh is employed for ventilator 33 located at the lower side of delivery opening 29, it is desirable that the relationship between an eye opening Y of the mesh (being the aperture of the wire mesh) and the average volume diameter X of each toner particle should be $X \leqq Y \leqq 30X$, and more desirable that the relationship would be $X \leqq Y \leqq 10X$.

Concretely speaking, when toner particles T having an average volume diameter X=10 $\mu$m are employed, ventilator 33 having eye opening Y=10–300 $\mu$m is acceptable, while 20–100 $\mu$m is desirable, and 40–90 $\mu$m is more desirable, and 77 $\mu$m is the most suitable, for collecting toner particle T.

When eye opening Y is smaller than the average volume diameter X, the efficiency of deaeration decreases considerably, since air ventilation through the mesh holes is impeded, due to the excessively fine mesh of the plane-weaved stainless wire. Accordingly, the collection of the toner particles would drop from delivery opening 29, since the packing force in the cover of toner particles, formed in delivery opening 29, is insufficient, due to weak cohesive force between particles in the collection of toner particles formed in inner hollow room 32B.

On the other hand, when eye opening Y exceeds 30X, the toner particles would pass through the mesh holes with the deaerating air, due to such an excessively coarse mesh of the plane-weaved stainless wire. As a result, it becomes difficult to form a collection of toner particles having a high mass density in inner hollow room 32B. Even if a collection of the toner particles is formed, it would drop from delivery opening 29, due to insufficient packing density of the collection.

Although the abovementioned ventilator 33 is formed of stainless steel wire mesh, it is also applicable to employ a mesh weaved by other metal wires being lightweight and durable for heat, pressure and corrosion or by non-ferrous metal wires such as Kevler fibers, etc.

(c) When a non-textured fiber filter is employed for ventilator 33, as for toner particles T being less than 5 $\mu$m in diameter, a non-textured fiber filter having a collection efficiency of 85–99.5% is desirable, while 95–99% is more desirable, and specifically, the non-textured fiber filter having the collection efficiency of 98.5% used for the dustproof mask (manufactured by 3M Co. of U.S.A.) is the most suitable.

When a non-textured fiber filter having a collection efficiency exceeding 99.5% is employed for ventilator 33, the efficiency of deaeration decreases considerably, since fiber meshes are blocked by the toner particles and air ventilation through the fiber mesh is impeded. Accordingly, it becomes impossible to form a collection of the toner particles having a high mass density in inner hollow room 32B. Even if a collection of the toner particles is formed, it would drop from delivery opening 29, due to insufficient mass density of the collection.

On the other hand, when a non-textured fiber filter having the collection efficiency being less than 85% is employed for ventilator 33, the toner particles would pass through the fiber mesh with the deaerating air. As a result, it becomes difficult to form a collection of the toner particles having a high mass density. Even if a collection of the toner particles were formed, it would drop from delivery opening 29, due to insufficient mass density of the collection.

Although the abovementioned ventilator 33 is formed of a non-textured fiber filter, it is also applicable to employ a spongy member, organic or inorganic cellular member having a scavenging property such as pulp materials used for the filtering paper, or metallic material such as a steel wool, etc.

Figure 4:
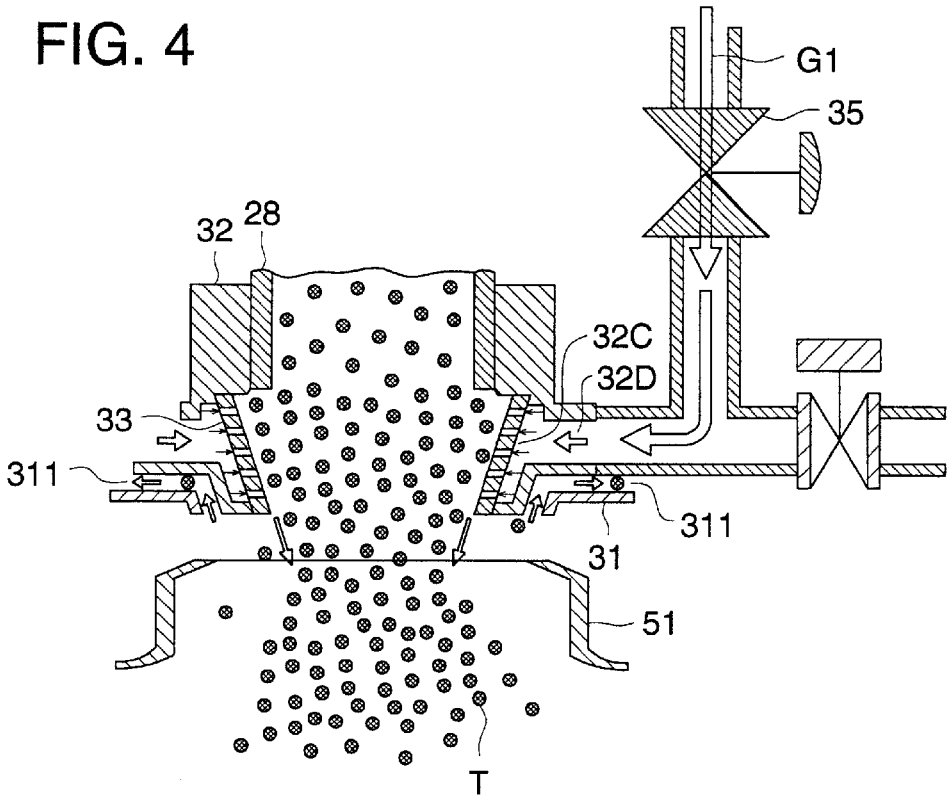
FIG. 4 shows a cross-sectional view illustrating the state of delivery of toner particles from the delivery opening, embodied in the present invention.

FIG. 4 shows a cross-sectional view illustrating a state of delivering toner particles T from delivery opening 29, embodied in the present invention.

When compressor 36 is driven, compressor 36 sends pressurized airflow G1 to outer hollow room 32C through ventilation ducts 32D by closing electromagnetic valve 37 and by opening electromagnetic valve 35. Pressurized airflow G1 inflows into inner hollow room 32B after passing through ventilator 33 and blows into the gaps between condensed toner particles T to decrease the density of toner particles and to widen the distances between toner particles. As a result, toner particles T are scattered and movable relative to each other.

Then, toner particles T, relieved from the state of high mass density and being in an easily movable state, outflow from opening section 33A of ventilator 33 and are delivered into container 51 to be stored.

Figure 5:
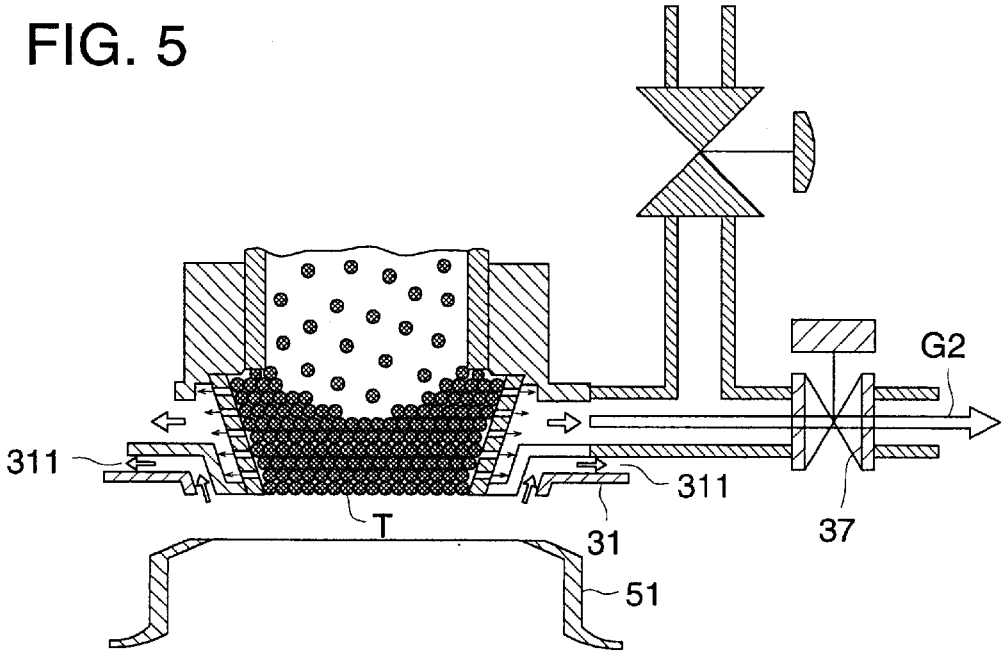
FIG. 5 shows a cross-sectional view illustrating the deaerated state of blocked particles existing at the delivery opening, embodied in the present invention.

FIG. 5 shows a cross-sectional view illustrating the deaerated state of blocking toner particles T coming from delivery opening 29, embodied in the present invention.

When depressurizing pump 38 is driven, depressurizing pump 38 absorbs depressurized airflow G2 from outer hollow room 32C through ventilation ducts 32D by closing electro-magnetic valve 35 and by opening electro-magnetic valve 37. Depressurized airflow G2 increases the mass density of toner particles T by absorbing the air existing among toner particles T, to form a collection of toner particles T of high mass density in ventilator 33, which tightly seals the aperture of delivery opening 29. Accordingly, the collection of toner particles T of high mass density seals the end portion of delivery opening 29 as if closed with a cover.

The absorbing pressure (the deaerating pressure) is set at 100 mmAq, when the sintered metal or the plain-weaved stainless mesh plate is employed for ventilator 33, while is set at 10 mmAq, when a textured fiber filter is employed. Incidentally, the starting time of the deaerating action substantially coincides with the time when the filling action of toner particles T into container 51 is finished.

The abovementioned absorbing pressure is derived from measuring the differential pressure referred to as the atmospheric pressure by means of a differential manometer. The unit [mmAq] indicates the height of the differential manometer in an aqua.

When the collection of toner particles tightly seals the end portion of delivery opening 29, container 51 filled with toner particles T is removed from container-holding means 52, and then, is replaced by another such empty container 51.

Figure 6:
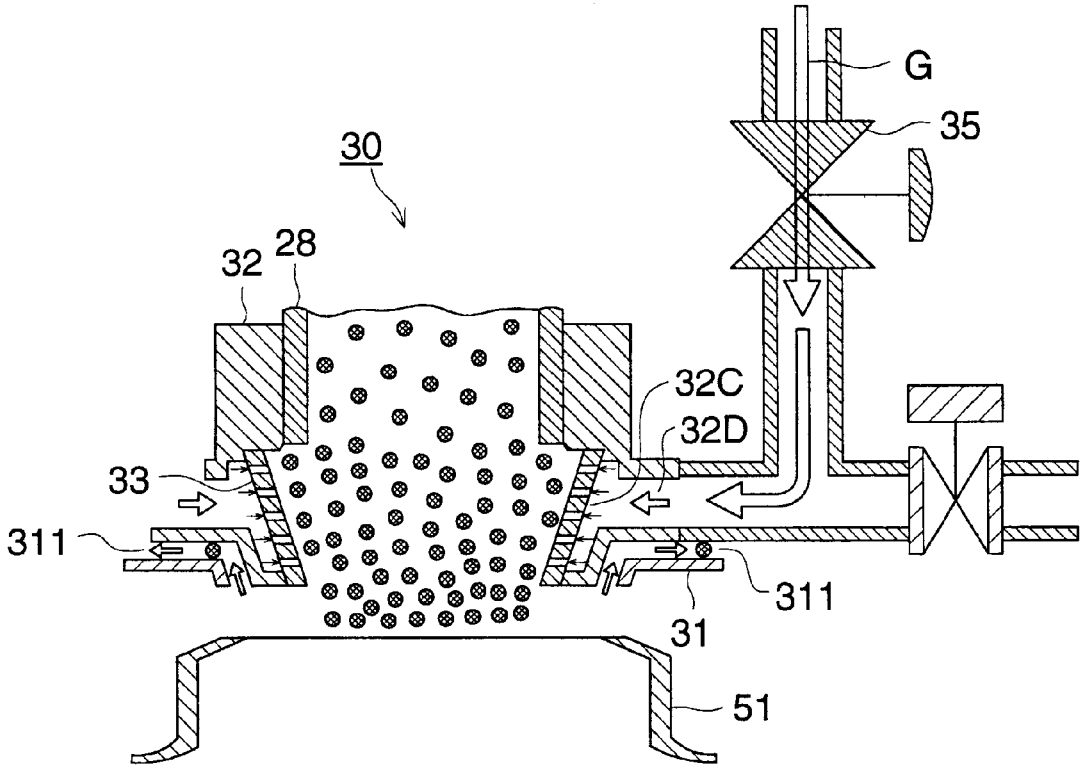
FIG. 6 shows a cross-sectional view of the toner supplying apparatus, illustrating the state of the reversal cleaning, embodied in the present invention.

Although, according to the abovementioned process, delivery opening 29 is tightly sealed by the collection of toner particles formed by the deaerating action, it is necessary to clean ventilator 33 at appropriate times. As shown in FIG. 6, the cleaning of ventilator 33 is achieved by momentarily blowing compressed air, having a higher pressure than pressurized airflow G1, against ventilator 33 to loosen and scatter toner particles caught in its mesh holes (hereinafter, this process is referred to as reversal cleaning).

FIG. 6 shows a cross-sectional view of particles-supplying apparatus, illustrating the state of reversal cleaning, namely, forced air supply into deaerated particles.

The reversal cleaning is performed just before the time or at the same time when the filling action of toner particles T into container 51 is started. When compressor 36 is driven, compressor 36 momentarily sends high-pressure air G3 to outer hollow room 32C through ventilation ducts 32D included in supplying path 30 by closing electromagnetic valve 37 and by opening electromagnetic valve 35.

The pressure pulse of 1–1.5 kg/cm$^2$ for the reversal cleaning is momentarily applied to ventilator 33. Duration of the reversal cleaning is set at such a short time as being less than 1 second by means of timer 39. The reversal cleaning is performed within the limit of the mechanical strength of ventilator 33, in order to prevent damage of it.

Figure 7:
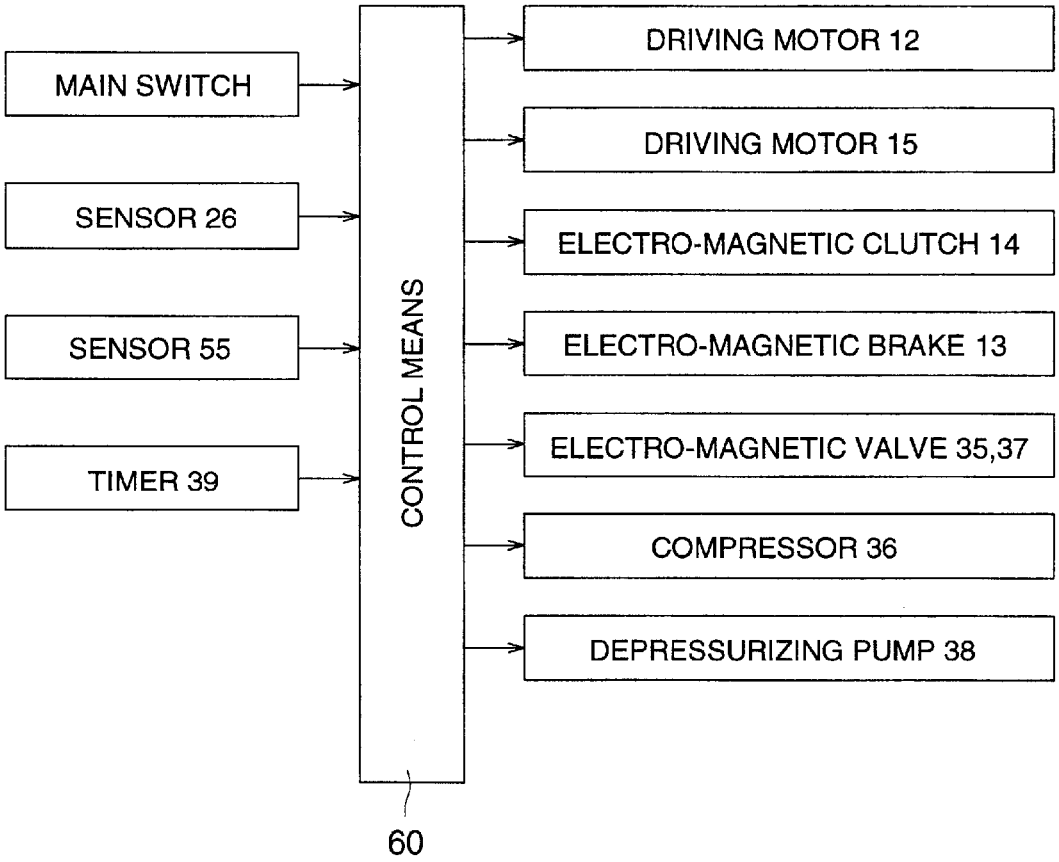
FIG. 7 shows a block-diagram of the control system of the particles-supplying apparatus embodied in the present invention.

FIG. 7 shows a block-diagram of the control system of the particles-supplying apparatus embodied in the present invention.

Control means 60 controls the driving source comprised of driving motors 12, 15, the drive controlling member comprised of electromagnetic brake 13 and electromagnetic clutch 14, the aerating/deaerating means comprised of compressor 36, depressurizing pump 38 and electromagnetic valves 35, 37, the sliding means for sliding cover 41, etc., based on the inputted data coming from the main-switch, sensor 26, sensor 55 and timer 39.

In addition, control means 60 controls the series of actions for increasing or decreasing the density of toner particles T residing in the end portion of particles-supplying path 27, the process for setting container 51 on the apparatus, the fill amount of toner particles T in container 51 set on the apparatus and the timing of stopping toner particles supply in container 51 after positioning container 51 into the apparatus.

Figure 8:
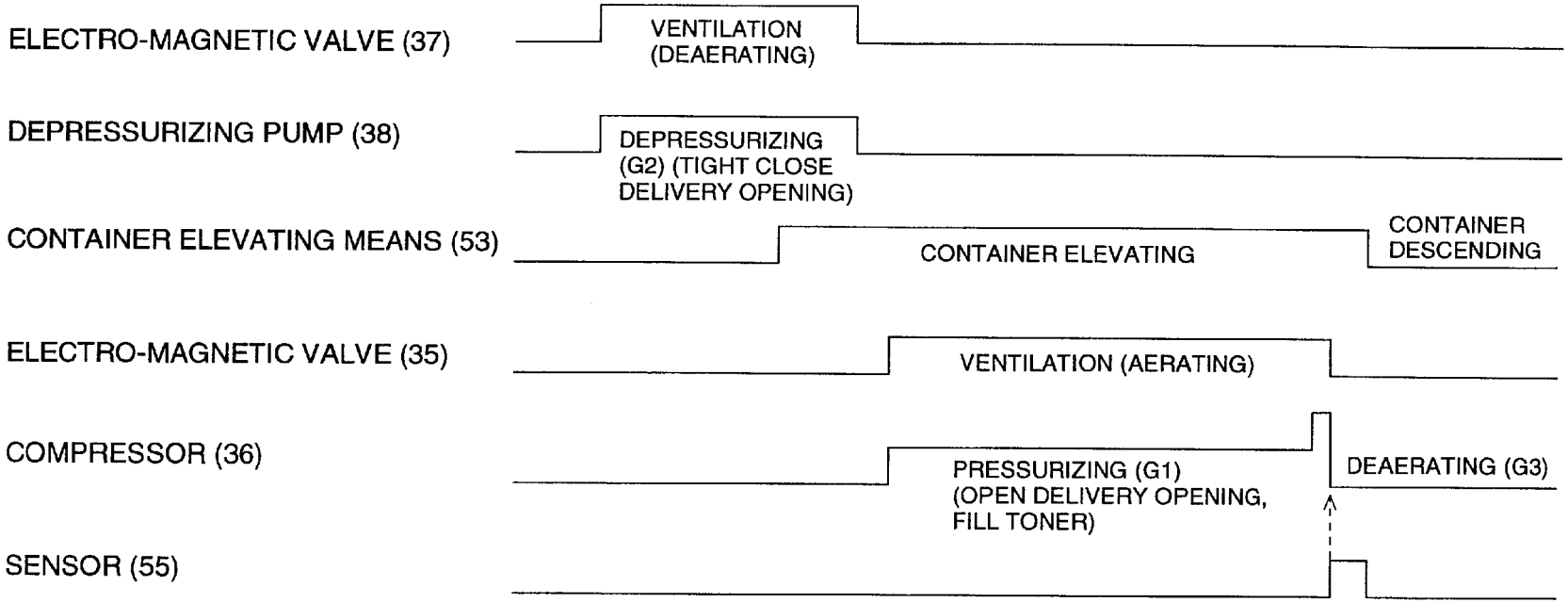
FIG. 8 shows a timing chart, indicating the sequential process of the particles-supplying apparatus embodied in the present invention.

FIG. 8 shows a timing chart, indicating the process sequence of the particles-supplying apparatus embodied in the present invention.

(1) When depressurizing pump 38 is driven and electromagnetic valve 37 is opened, the deaerating action of absorbing the air from ventilator 33 increases the density of toner particles T existing in the interior of ventilator 33. As a result, the collection of toner particles T maintains the interior of ventilator 33 in a tightly closed state.

(2) After a predetermined time has passed, the lower portion of opening section 33A of ventilator 33 is opened and maintained in the open state.

(3) Container-elevating means 53 is activated to elevate container 51.

(4) When compressor 36 is driven and electromagnetic valve 35 is opened, the aerating action of supplying pressurized air G1 to the interior of ventilator 33 decreases the density of toner particles T existing in the interior of ventilator 33. As a result, the collection of toner particles T is relieved from the state of the high mass density, and scattered toner particles T outflow from opening section 33A of ventilator 33 and are delivered into container 51 to be stored.

(5) Just before the time or at the same time when sensor 55 detects the finalization of the filling process of toner particles T into container 51, or the predetermined time set by timer 39 has passed, the deaerating action by means of depressurizing pump 38 is performed. Then, a collection of toner particles T maintains the interior of ventilator 33 in tightly closed state and effectively closes delivery opening 29.

Shutter means 40 may be arranged at lower side of the particles-supplying path 27 in the structure embodied in the present invention and is comprised of, for instance, shutter housing 41 and sliding shutter 42 as shown in FIG. 2(*b*). Opening section 41A formed in shutter housing 41 is located right under opening section 33A of ventilator 33, embodied in the present invention. Opening section 41A allows the particles to pass through inlet opening 51A of container 51, which is capable of being elevated and lowered.

Sliding shutter 42, moved by a driving mechanism (not shown in the drawings), opens and shuts opening section 41A.

Casing section 41B is formed at the periphery of opening section 41A of shutter housing 41. Ventilation duct 41C, led through casing section 41B, is connected to a depressurizing pump (not shown in the drawings).

When the depressurizing pump (not shown in the drawings) is driven, particles, such as toner particles, etc., floating around lower side of opening section 33A and/or attached to sliding shutter 42, are absorbed and delivered outside of the apparatus through casing section 41B and ventilation duct 41C by depressurized airflow generated by the depressurizing pump.

Table 1 shows various kinds of data for comparison between an embodiment of the present invention and a comparison example. The particles-supplying apparatus shown in FIG. 1 is employed as the embodiment of the present invention, while the conventional particles-supplying apparatus is employed as the comparison example, in which means for adjusting the density of particles is excluded from the apparatus shown in FIG. 1 and, instead, the conventional shutter cover is incorporated.

Incidentally, a falling preventive mechanism shown in Table 1 is a sliding cover or a capping cover incorporated at delivery opening 29.

TABLE 1

| | Presence or Absence of a preventive mechanism | | Mesh diameter (μm) Container-periphery | Evaluation items (generation ratio of contaminated container (%)) | | | | | |
|---|---|---|---|---|---|---|---|---|---|
| | | | | Capturing ratio (%) | | | Amount of particle aggrega- | Comparison example or | |
| No. | for falling | Adjusting mean | contamina-tion ratio (%) | Rank A | Rank B | Rank C | tions in container | Present invention | Comment |
| 1 | Presence | Absence | — | 0 | 0 | 100 | 0.3g | Comparison example | using capping cover at the delivery opening |
| 2 | Presence | Absence | — | 0 | 0 | 100 | 0.5g | Comparison example | using sliding cover at the delivery opening |
| 3 | Absence | sintered metal | 8 μm | 45 | 55 | 0 | 0 | Present invention | practically applicable level |
| 4 | Presence | sintered metal | 10 μm | 83 | 17 | 0 | 0 | Present invention | desirable level |
| 5 | Absence | sintered metal | 10 μm | 79 | 21 | 0 | 0 | Present invention | desirable level |
| 6 | Absence | sintered metal | 70 μm | 98 | 2 | 0 | 0 | Present invention | more desirable level |
| 7 | Absence | sintered metal | 120 μm | 100 | 0 | 0 | 0 | Present invention | best level |
| 8 | Absence | sintered metal | 135 μm | 100 | 0 | 0 | 0 | Present invention | best level |
| 9 | Absence | sintered metal | 150 μm | 85 | 15 | 0 | 0 | Present invention | desirable level |

TABLE 1-continued

| No. | Presence or Absence of a preventive mechanism for falling | Adjusting mean | Mesh diameter (μm) Container-periphery contamination ratio (%) | Evaluation items (generation ratio of contaminated container (%)) Capturing ratio (%) Rank A | Rank B | Rank C | Amount of particle aggregations in container | Comparison example or Present invention | Comment |
|---|---|---|---|---|---|---|---|---|---|
| 10 | Absence | sintered metal | 160 μm | 43 | 57 | 0 | 0 | Present invention | practically applicable level |
| 11 | Absence | stainless steel mesh | 8 μm | 47 | 53 | 0 | 0 | Present invention | practically applicable level |
| 12 | Presence | stainless steel mesh | 15 μm | 97 | 3 | 0 | 0 | Present invention | desirable level |
| 13 | Absence | stainless steel mesh | 15 μm | 92 | 8 | 0 | 0 | Present invention | desirable level |
| 14 | Absence | stainless steel mesh | 40 μm | 99 | 1 | 0 | 0 | Present invention | more desirable level |
| 15 | Absence | stainless steel mesh | 77 μm | 100 | 0 | 0 | 0 | Present invention | best level |
| 16 | Absence | stainless steel mesh | 100 μm | 94 | 6 | 0 | 0 | Present invention | more desirable level |
| 17 | Absence | stainless steel mesh | 200 μm | 82 | 18 | 0 | 0 | Present invention | desirable level |
| 18 | Absence | stainless steel mesh | 220 μm | 64 | 36 | 0 | 0 | Present invention | practically applicable level |
| 19 | Absence | non-textured fiber filter | 70% | 61 | 39 | 0 | 0 | Present invention | practically applicable level |
| 20 | Presence | non-textured fiber filter | 70% | 83 | 17 | 0 | 0 | Present invention | practically applicable level |
| 21 | Absence | non-textured fiber filter | 85% | 95 | 5 | 0 | 0 | Present invention | practically applicable level |
| 22 | Absence | non-textured fiber filter | 90% | 98 | 2 | 0 | 0 | Present invention | more desirable level |
| 23 | Absence | non-textured fiber filter | 98.50% | 100 | 0 | 0 | 0 | Present invention | best level |
| 24 | Absence | non-textured fiber filter | 99.00% | 100 | 0 | 0 | 0 | Present invention | best level |
| 25 | Absence | non-textured fiber filter | 99.50% | 92 | 8 | 0 | 0 | Present invention | desirable level |
| 26 | Absence | non-textured fiber filter | 99.80% | 74 | 26 | 0 | 0 | Present invention | practically applicable level |
| 27 | Absence | Absence | — | 0 | 0 | 100 | 2.0g | Comparison example | without density control |
| 28 | Absence | changing the aperture of the delivery opening | — | 80 | 20 | 0 | 0 | Present invention | decreasing the aperture of the delivery opening at 3% |

In Table 1, the data shown in lines No. 1, 2 indicates the evaluation data for a conventional particles-supplying apparatus which incorporates a sliding cover or a capping cover, and does not perform the novel density control of the particles. The data shown in line No. 27 indicates the evaluation data for the conventional particles-supplying apparatus which does not incorporate a sliding cover or a capping cover, and also does not perform the density control of the particles. The data shown in lines No. 3–10 indicates the evaluation data for the embodiment in which a sintered metal is employed for ventilator 33.

Data shown in lines No. 11–18 indicates the evaluation data for the embodiment in which a stainless steel mesh is employed for ventilator 33 and the diameter of each toner particle is about 10 μm.

The data shown in lines No. 19–26 indicates the evaluation data for the embodiment in which a non-textured fiber filter is employed for ventilator 33.

As shown in the experimental data indicated in Table 1, the container-periphery contamination ratios are the best for No. 7 and No. 8 in the sintered metal and for No. 2 and No. 24 in the non-textured fiber filter.

Incidentally, after the toner filling process is continuously applied to 500 containers under each condition, the container-periphery contamination ratio is derived from an average value of toner contamination values measured for 100 containers arbitrarily sampled from the 500 containers.

In the column of the container-periphery contamination ratio (%), rank A indicates the ratio of containers having no toner contamination after the filling process, rank B indicates the ratio of containers having toner contamination of particles less than 0.6 mm in diameter and rank C indicates the ratio of containers having toner contamination of particles greater than 0.6 mm in diameter.

The amount of particle aggregations in each container of the abovementioned 100 containers is derived by weighing particle aggregation remaining after sifting 10 grams of toner with a 375 mesh under negative pressure. Although, mixtures of aggregations are recognized in the comparison example, no mixture of aggregations is recognized in the embodiment of the present invention, which employs a sintered metal, a stainless steel mesh or a non-textured fiber filter.

According to the present invention, since the function of the sealing is achieved by particles themselves, it becomes possible to prevent natural falling of particles through the delivery opening, and to eliminate the shutter cover, for preventing the downfall of particles, from the particles-supplying apparatus, and further, to prevent the generation of aggregations formed by moving actions of the shutter cover. As a result, improvement of the working environment in the periphery of the particles-supplying apparatus, delivery of high-quality particles products including no aggregations, simplification of the particles-supplying apparatus and minimization of the apparatus are achieved.

According to the present invention, it becomes possible to control the passing action of particles in the particles-supplying path by adding the function of a shutter cover to particles themselves by deaerating particles existing in the vicinity of the delivery opening of the particles-supplying path and by aerating again the cohesive collection of particles.

What is claimed is:

1. A particles-supplying apparatus, comprising:

a particles-supplying path connected to a supplying section of particles at one end of it, and having a delivery opening for discharging said particles at the other end of it; and a passage controller for forming a cover consisting of at least a part of said particles by changing a density of at least a part of said particles existing in said particles-supplying path so as not to discharge said particles from said delivery opening.

2. The particles-supplying apparatus of claim 1, wherein said passage controller absorbs gas from at least a part of said particles existing in said particles-supplying path for forming said cover, and said passage controller supplies gas to at least a part of said particles forming said cover so as to discharge said particles from said delivery opening.

3. The particles-supplying apparatus of claim 1, wherein said passage controller comprises a ventilator.

4. The particles-supplying apparatus of claim 3, wherein said ventilator is located in the vicinity of said delivery opening of said particles-supplying path.

5. The particles-supplying apparatus of claim 3, wherein said ventilator is made of a sintered metal having filtering holes of 10–150 μm in each diameter.

6. The particles-supplying apparatus of claim 3, wherein a structure of said ventilator comprises a rigid mesh having eye openings of Y [μm] which fulfill a following relationship with an average volume diameter of X [μm] for each of said particles, $$X \leqq Y \leqq 30X, \text{ and } 3\ [\mu m] \leqq X \leqq 20\ [\mu m].$$

7. The particles-supplying apparatus of claim 3, wherein said ventilator comprises a fiber cloth having a collection efficiency of 85%–99.5% for fine particles being less than 5 μm in each diameter.

8. The particles-supplying apparatus of claim 3, wherein said particles are discharged from said delivery opening through said ventilator.

9. The particles-supplying apparatus of claim 1, wherein a diameter of said delivery opening is smaller than a diameter of said particles-supplying path.

10. The particles-supplying apparatus of claim 1, further comprising:

a shutter, mounted downward said delivery opening, for preventing said particles from discharging.

11. The particles-supplying apparatus of claim 1, further comprising:

a container holder for holding a container, which contains said particles discharged, at a predetermined position; and a container elevator for elevating and lowering said container holder, which elevates an opening of said container close to said delivery opening, when supplying said particles to said container.

12. The particles-supplying apparatus of claim 11, further comprising:

a sensor for detecting an existence of said container and a filling amount of said particles in said container.

13. A control method for discharging particles, comprising steps of:

passing particles through a particles-supplying path connected to a supplying section of said particles at one end of it, and having a delivery opening for discharging said particles at the other end of it; and controlling to form a cover consisting of at least a part of said particles by changing a density of at least a part of said particles existing in said particles-supplying path so as not to discharge said particles from said delivery opening.

14. The control method of claim 13, wherein said controlling step includes a step of absorbing gas from at least a part of said particles existing in said particles-supplying path for forming said cover, and said control method further comprises a step of supplying gas to at least a part of said particles forming said cover so as to discharge said particles from said delivery opening.

15. The control method of claim 14, further comprising a steps of:

ventilating gas from/to said particles through said ventilator made of a sintered metal having filtering holes of 10–150 $\mu$m in each diameter, and located at said particles-supplying path.

16. The control method of claim 14, further comprising a step of:

ventilating gas from/to said particles through said ventilator, wherein said ventilator comprises a rigid mesh having eye openings of Y [$\mu$m] which fulfill a following relationship with an average volume diameter of X [$\mu$m] for each of said particles, $$X \leqq Y \leqq 30X, \text{ and } 3\ [\mu m] \leqq X \leqq 20\ [\mu m].$$

17. The control method of claim 14, further comprising a step of:

ventilating gas from/to said particles through said ventilator, wherein said ventilator comprises a fiber cloth having a collection efficiency of 85%–99.5% for fine particles being less than 5 $\mu$m in each diameter.

18. The control method of claim 13, further comprising a step of:

ventilating gas from/to said particles through a ventilator, located at said particles-supplying path, for changing said density.

19. The control method of claim 18, wherein said ventilator is located in the vicinity of said delivery opening of said particles-supplying path.

20. The control method of claim 13, wherein a diameter of said delivery opening is smaller than a diameter of said particles-supplying path.

21. The control method of claim 13, further comprising a step of:

controlling a discharge of said particles in response to a presence or absence of a high density particles exiting in said particles-supplying path.

22. The control method of claim 13, further comprising steps of:

detecting whether or not a container, for containing said particles discharged, is set; and controlling a discharge of said particles in accordance with a result of said detecting step.

23. A control method for flowing solid-state substances, comprising steps of:

letting solid-state substances existing in a flowing fluid, so as to flow said solid-state substances with said flowing fluid in a flowing path; and allowing a flow of said solid-state substances to be restrained or to be free, by sucking said flowing fluid from said flowing path toward outside of said flowing path, or by gushing said flowing fluid into said flowing path from outside of said flowing path.

24. A toner supplying apparatus, comprising:

a supplying section of toner;

a toner-supplying path connected to said supplying section of toner at one end of it, and having a delivery opening for discharging said toner at the other end of it; and a passage controller for forming a cover consisting of at least a part of said toner by changing a density of at least a part of said toner existing in said toner-supplying path so as not to discharge said toner from said delivery opening.

25. A control method for discharging toner, comprising steps of:

passing developer through a toner-supplying path connected to a supplying section of toner at one end of it, and having a delivery opening for discharging said toner at the other end of it; and controlling to form a cover consisting of at least a part of said toner by changing a density of at least a part of said toner existing in said toner-supplying path so as not to discharge said toner from said delivery opening.

* * * * *